US006860017B1

(12) United States Patent
Mennicken

(10) Patent No.: US 6,860,017 B1
(45) Date of Patent: Mar. 1, 2005

(54) SINGLE-SPRING OR DOUBLE-SPRING BIASED NIPPER

(76) Inventor: Jerry Mennicken, 3083 Dos Lomas, Fallbrook, CA (US) 92028

( * ) Notice: Subject to any disclaimer, the term of this patent is extended or adjusted under 35 U.S.C. 154(b) by 182 days.

(21) Appl. No.: 10/103,677

(22) Filed: Mar. 20, 2002

Related U.S. Application Data

(60) Provisional application No. 60/277,793, filed on Mar. 21, 2001.

(51) Int. Cl.[7] ..... B26B 13/00

(52) U.S. Cl. ..... 30/261; 30/175; 30/186; 30/341; 29/268; 29/275; 29/278; 81/304; 81/427.5

(58) Field of Search ..... 30/186, 175, 341, 30/191–193, 26, 28, 145, 261, 262; 7/130, 133, 125; 29/268, 275, 278; 81/304, 427.5

(56) References Cited

U.S. PATENT DOCUMENTS 3,430,340 A * 3/1969 Perles ..... 30/28
3,680,210 A * 8/1972 Steinman ..... 30/28
4,073,179 A * 2/1978 Hickey et al. ..... 72/409.17
4,708,034 A * 11/1987 Oetiker ..... 81/9.3
4,739,552 A * 4/1988 Thomas ..... 30/28
5,214,854 A 6/1993 Mennicken
5,314,431 A * 5/1994 Graziano ..... 606/101
5,437,679 A * 8/1995 Gaillard ..... 606/131
6,517,545 B1 * 2/2003 Mazur ..... 606/83

* cited by examiner

*Primary Examiner*—Timothy V. Eley
*Assistant Examiner*—Phong Nguyen
(74) *Attorney, Agent, or Firm*—Marger Johnson & McCollom, P.C.

(57) ABSTRACT

A nipper is disclosed, having handles outwardly-biased by a spring and a removable, flexible lever member can be a second spring. The biasing force can thereby be adjusted by employment or removal of flexible lever member.

12 Claims, 3 Drawing Sheets

SINGLE-SPRING OR DOUBLE-SPRING BIASED NIPPER

CROSS-REFERENCE TO RELATED APPLICATIONS

This application claims priority from U.S. Provisional Application No. 60/277,793, filed on Mar. 21, 2001, which is incorporated by reference.

BACKGROUND OF THE INVENTION

The present invention is related to the field of spring-biased nippers, and more specifically to the manner in which the nipper handles are biased apart.

Conventional nippers, such as those for cutting toe nails or cuticles, comprise a pair of handles connected for pivoting movement relative to one another. One side of the nipper cutting jaw extends beyond the pivot point on each handle so that when the handles are brought together, the jaws close and cut. Biasing means are provided between the handles to bias them apart so that after a user squeezes the handles together to cause the jaws to cut, the handles move apart when the user's grip is relaxed thus opening the cutting jaws and readying the nippers for the next cut.

One prior art nipper biasing means comprises a single leaf spring affixed to one handle and having an end which abuts the other handle. Although the spring provides biasing, the spring is relatively stiff, which causes wear as the spring moves against the handle, and also results in occasional breaking of the spring.

Another prior art biasing device comprises a pair of leaf springs each having one end affixed to opposing nipper handles with each of the other spring ends connected to each other between the handles. This also is relatively stiff and like the single leaf spring is labor intensive to assemble.

The invention will become more readily apparent from the following Detailed Description, which proceeds with reference to the drawings, in which:

DETAILED DESCRIPTION OF THE PREFERRED EMBODIMENT(S)

Figure 1:
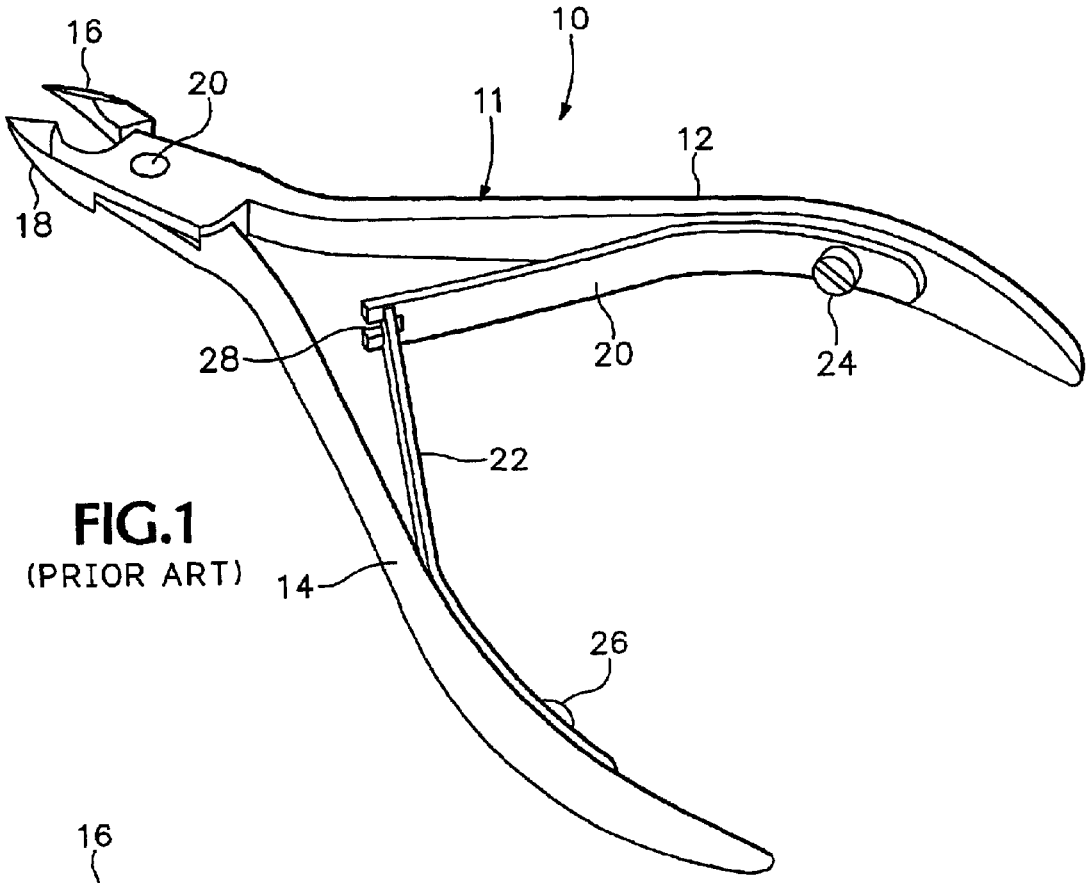
FIG.1 (PRIOR ART)
FIG. 1 is a perspective view of a nipper of the prior art that uses a pair of leaf springs.

Commonly-owned U.S. Pat. No. 5,214,854 (to Mennicken) (incorporated herein by reference for all purposes) teaches a nipper having a helical spring operative to outwardly bias the nipper handles. Like numerals that identify nipper structures in the drawings of the '854 patent correspond to similar structures in the present application.

Figure 2:
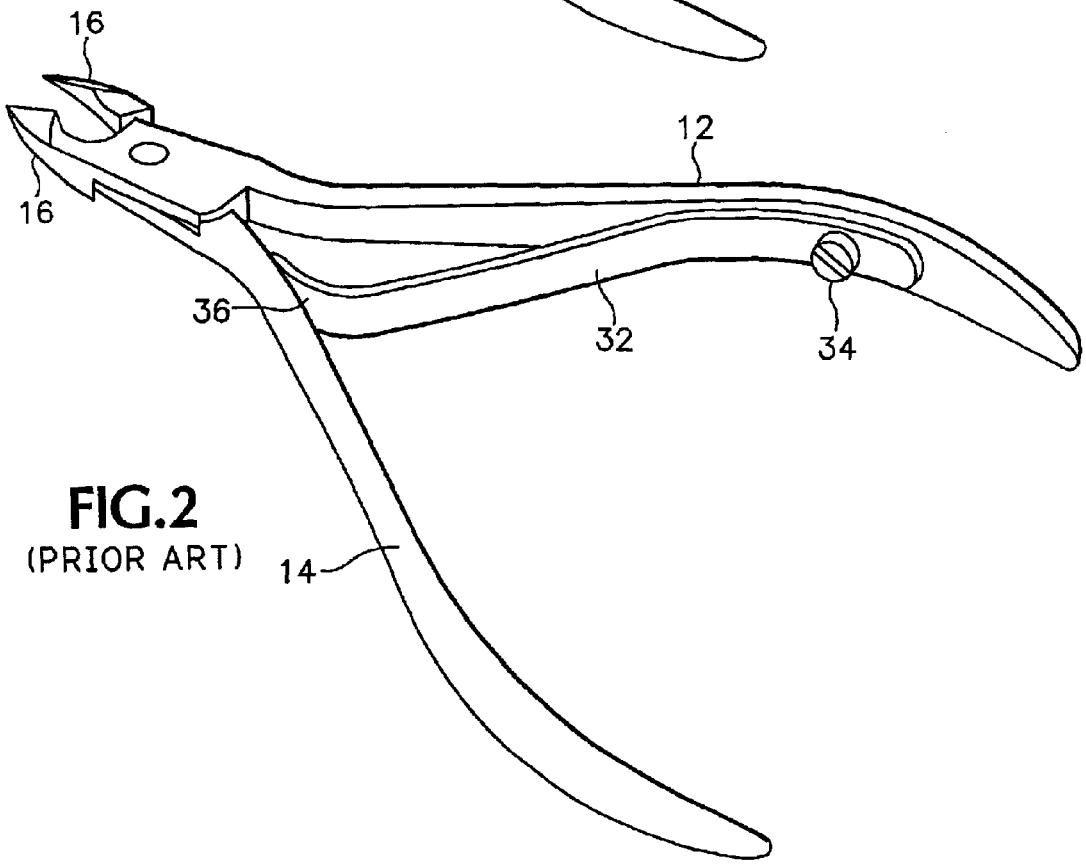
FIG.2 (PRIOR ART)
FIG. 2 is a perspective view of a nipper of the prior art that uses a single leaf spring.

FIG. 1 is a perspective view of a prior art double-spring biased nipper, and FIG. 2 is a perspective view of a prior art single-spring biased nipper. In each of the drawings, the same numeral identifies corresponding structure.

Considering first the prior art nipper of FIG. 1, a pair of springs 20, 22 are each attached to the inside of the first and second nipper handles 12, 14, respectively, via screws 24, 26, respectively, which are each threadably engaged in a bore (not visible) formed in the associated nipper handle. The nipper comprises a spring 20 that includes a notch 28 formed at one end thereof. A second spring 22, secured to the second handle, has tab 30 that engages notch 28 in spring 20.

Turning now to the prior art nipper of FIG. 2, a single spring 32 is secured to handle 12 by a screw 34. Spring 32 comprises a single-leaf spring that includes a bearing surface 36. The bearing surface rides against an inner surface of handle 14, not visible in the view of FIG. 2. As the handles 12, 14 are squeezed together, surface 36 rides along the inner surface of handle 14 toward jaws 16, 18. As the handles move together, they compress or flex leaf spring 32, thereby creating a biasing force that urges the handles outwardly to the position shown in FIG. 2 when the nipper handles are released.

In operation, when handles 12, 14 of the nipper 10 are squeezed together, springs 20, 22 bend in a manner that moves notch 28 and tab 30 toward jaws 16, 18 while remaining engaged with one another. Similarly, the portions of springs 20, 22 that are not held against nipper handles 12, 14, respectively, move toward the nipper handles. This creates a spring biasing force so that when the handles are released, they are biased back into an open position as shown in FIG. 1.

Figure 3:
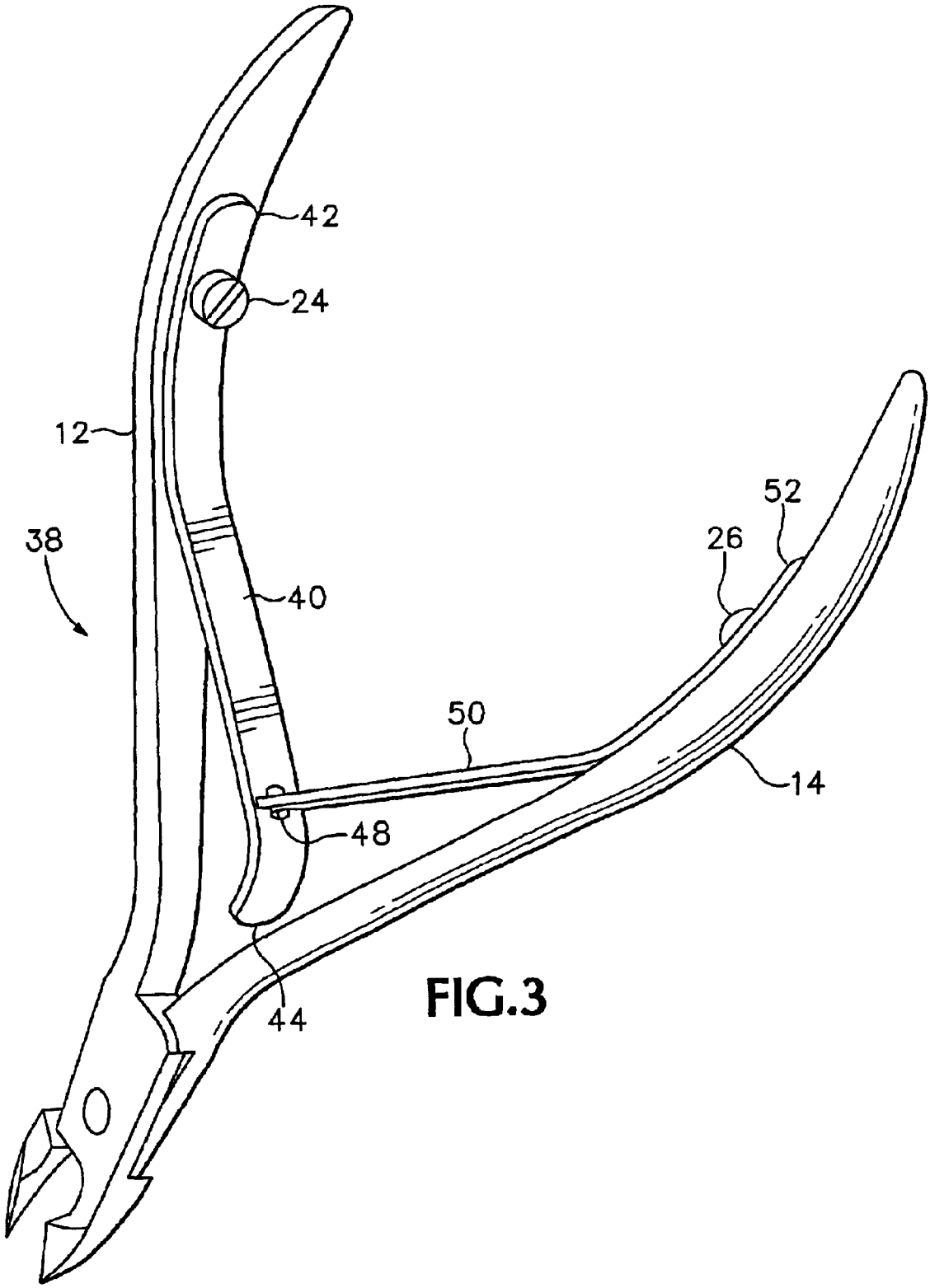
FIG. 3 is a perspective view of a nipper constructed according to the present disclosure.

Turning now to FIG. 3, indicated generally at 38 is a nipper constructed in accordance with the present invention. Included therein is a spring 40, first end 42 of which is secured to the inner surface of handle 12 by a screw 24. The spring 40 includes an arcuate portion 46 positioned proximate a second end 44. It can be seen that spring 40 is built substantially identically to spring 32, except that there is an elongate opening 48 formed in spring 40.

A lever member 50 has a first end 52 adapted to be releasably secured to second handle 14, and second end 54 that includes tab 30. Tab 30 (visible in FIGS. 4–5) extends from second end 54 of lever member 50 and is adapted to be inserted into opening 48. In the view of FIG. 3, flexible lever member 50 preferably is a leaf spring having a tab 30.

Figure 4:
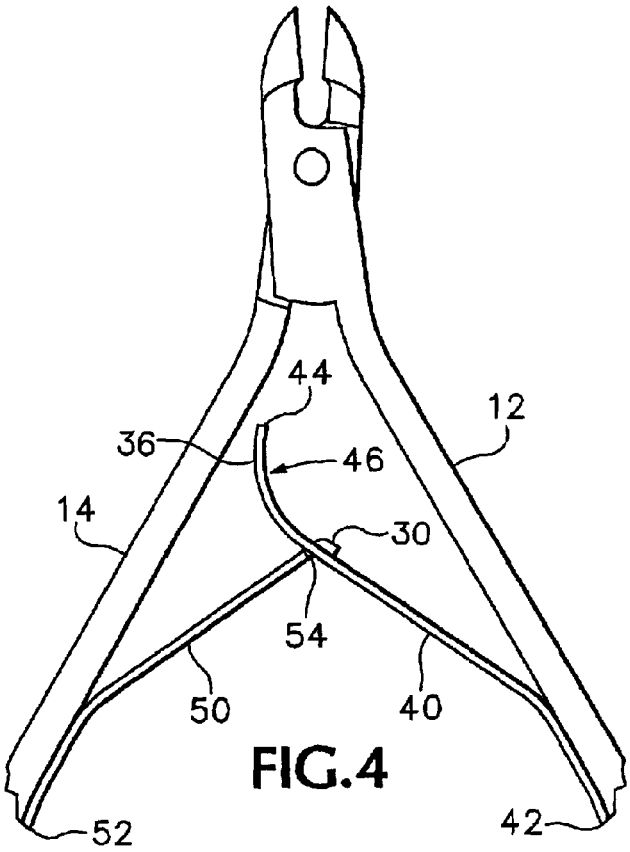
FIG. 4 is a side view of the nipper of FIG. 3 with squeezing pressure applied to the handles.
Figure 5:
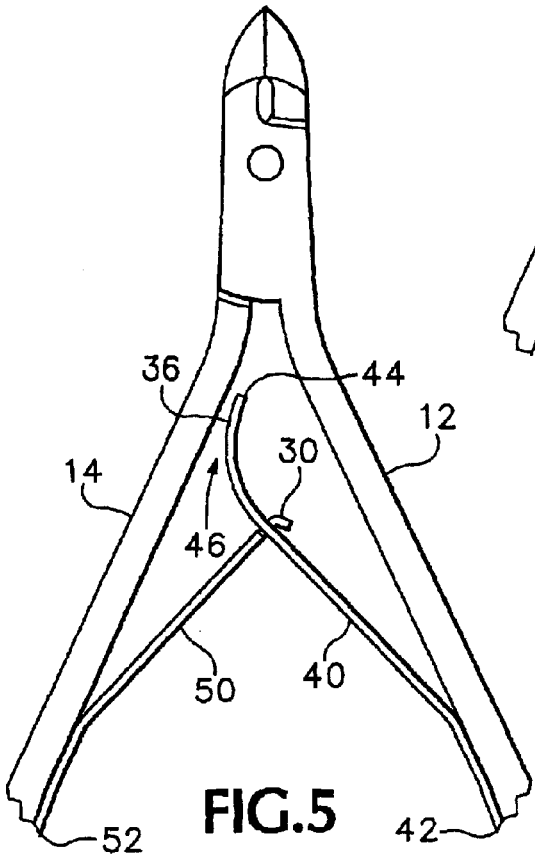
FIG. 5 is a side view of the nipper of FIG. 3 with no squeezing pressure applied to the handles.

As shown in FIGS. 4–5, tab 30 is received in opening 48. In the view of FIG. 5, an outer portion of tab 30 is bent relative to the tab that is received in notch 28, thereby engaging spring 20 and lever member 50 via the interaction of tab 30 and notch 28.

In operation, with no pressure applied to handles 12, 14, the nipper assumes the open position in FIG. 4. When the handles are squeezed together (FIG. 5), spring 40 and lever member 50 apply an outwardly biasing force on the handles, which return to the configuration of FIG. 4 when the handles are released.

It should be noted that, in the spring-biased nipper of FIGS. 3–6, bearing surface 36 does not touch the inner surface of handle 14 throughout the entire range of travel, i.e., between a position in which the nipper jaws are fully opened, as shown in FIG. 4, and a position in which they are fully closed, as shown in FIG. 5. As a result, the nipper of FIG. 3 provides nipper operation similar to that of the prior art nipper in FIG. 1.

Figure 6:
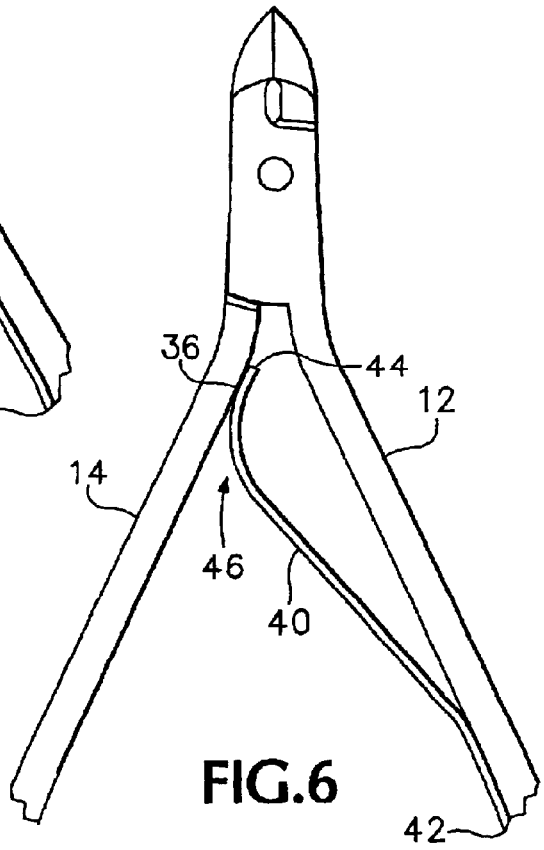
FIG. 6 is a side view of the nipper of FIG. 3, with lever member removed.

The present embodiment of the invention is shown in FIG. 6 with lever member 50 removed. Removal is accomplished by unscrewing screw 26 and removing tab 30 from opening 48. In this configuration, bearing surface 36 rides against the inner surface of handle 14, thus providing an outwardly-biasing force to nipper handles, similar to that of the prior art nipper in FIG. 2.

Due to manufacturing and assembling efficiencies, it is more cost effective to produce and sell only the nipper of the present invention as shown in FIGS. 3–5, rather than separately making and selling both the nipper of FIG. 1 and the nipper of FIG. 2, even though there are substantial markets for both double-spring biased nippers and single-spring biased nippers.

As a result of these manufacturing and assembling efficiencies, however, the nipper of FIGS. 3–5 can be sold with instructions for removing screw 26 and lever member 50, thus providing the single-spring biased nipper configured as shown in FIG. 6. On the other hand, if the customer prefers a double-spring biased nipper, it can be used as purchased (and the accompanying instructions can so state).

In the present embodiments of the nipper, all components are preferably formed from stainless steel.

A person skilled in the art will be able to practice the present invention in view of the description present in this document, which is to be taken as a whole. Numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. The inventor regards the subject matter of the invention to include all combinations and subcombinations of the various elements, features, functions and/or properties disclosed herein.

The invention claimed is:

1. A spring-biased nipper comprising:

a first handle and a second handle connected for pivoting movement toward and away from each other;

nipping jaws operably connected to said first and second handles for cutting responsive to movement of the handles; a first leaf spring, including:

a first end constructed for releasable securement secured to an inner surface of the first handle, a second end, an arcuate portion positioned proximate the second end and having a bearing surface adapted to slidably contacting an inner surface of the second handle, and an opening positioned intermediate the first and second ends, said opening configured to releasably receive therein an engaging tab; and a second leaf spring, including:

a first end constructed for releasable securement to the inner surface of the second handle, and a second end having an engaging tab, said engaging tab constructed for releasable insertion into the opening of the first leaf spring;

wherein said handles are biased away from one another; and wherein said sprint-biased nipper is structured to be operated in a user-selectable one of two operating modes:

a single-spring mode in which the arctuate portion of the first leaf spring slidably contacts the inner bearing surface of the second handle during cutting, and a dual-spring mode in which the engaging tab of the second leaf spring is releasably inserted into the opening of the first leaf spring and the arctuate portion of the first leaf spring does not contact the inner bearing surface of the second handle during cutting.

2. The spring-biased nipper of claim 1, wherein said handles are biased away from one another by the first leaf spring.

3. The spring-biased nipper of claim 1, wherein said handles are biased away from one another by the first and second leaf springs.

4. The spring-biased nipper of claim 1, wherein the bearing surface is operative to slidably contact the inner surface of the second handle when the second leaf spring is released from the second handles.

5. The spring-biased nipper of claim 1, wherein the second leaf spring is sized to prevent the bearing surface from slidably contacting the second handle when the second leaf spring is secured to the second handle and the engaging tab inserted into the opening.

6. The spring-biased nipper of claim 1, wherein:

the first leaf spring and the second leaf spring are operative to produce a tandem biasing force;

the first leaf spring is operative to produce a single biasing force when the second leaf spring is released from the second handle and the engaging tab is removed from the opening; and the tandem biasing force is greater than the single biasing force.

7. A spring-biased nipper comprising;

a first handle and a second handle connected for pivoting movement toward and away from each other;

nipping jaws operably connected to said first and second handles for cutting responsive to movement of the handles;

a leaf spring, including:

a first end constructed for releasable securement to an inner surface of the first handle, a second end, an arcuate portion positioned proximate the second end and having a bearing surface adapted to, in a first operating mode, slidably contact an inner surface of the second handle to produce a single biasing force to bias the handles away from one another, and a receiving aperture positioned intermediate the first and second ends and configured to releasably receive therein an engaging tab; and a lever member, including:

a first end constructed for releasable securement to the inner surface of the second handle, and a second end having an engaging tab constructed for releasable insertion into the receiving aperture of the leaf spring;

wherein the lever member is structured to, in a second operating mode, prevent the bearing surface from slidably contacting the inner surface of the second handle when the first end is releasably secured to the inner surface of the second handle and the engaging tab is inserted in the receiving aperture; and wherein the operating mode is interchangeably selectable by a user via securing or releasing of the lever member.

8. The spring-biased nipper of claim 7 wherein the lever member is a flexible lever member.

9. The spring-biased nipper of claim 8, wherein the flexible lever member partially flexes the leaf spring to produce a tandem biasing force that is greater than the single biasing force.

10. The spring-biased nipper of claim 8, wherein the flexible lever member is a flexible rod.

11. The spring-biased nipper of claim 8, wherein the flexible lever member is a flexible metallic strip.

12. The spring-biased nipper of claim 12, wherein the flexible lever member is a leaf spring.

* * * * *

UNITED STATES PATENT AND TRADEMARK OFFICE

CERTIFICATE OF CORRECTION

PATENT NO. : 6,860,017 B1
DATED : March 1, 2005
INVENTOR(S) : Mennicken

It is certified that error appears in the above-identified patent and that said Letters Patent is hereby corrected as shown below:

Title page,
Item [57], ABSTRACT,
Lines 1-3, replace "A nipper is disclosed, having handles outwardly-biased by a spring and a removable, flexible lever member can be a second spring." with -- A nipper is disclosed, having handles outwardly-biased by a spring and a removable, flexible lever member. The lever member can be a second spring. --.

Column 1,
Line 51, replace "FIG. 5 is" with -- FIG 4 is --.

Column 4,
Line 29, replace "comprising;" with -- comprising: --.

Signed and Sealed this

Twenty-first Day of February, 2006

JON W. DUDAS
*Director of the United States Patent and Trademark Office*